US005203181A

United States Patent [19]

Brossia et al.

[11] Patent Number: 5,203,181

[45] Date of Patent: Apr. 20, 1993

[54] CONTAINER-COOLER

[75] Inventors: Charles E. Brossia, Valley Park, Md.; Philip S. Desmond, Waukesha; Eckhard F. Rahn, Colgate, both of Wis.

[73] Assignee: Miller Brewing Company, Milwaukee, Wis.

[21] Appl. No.: 893,640

[22] Filed: Jun. 5, 1992

Related U.S. Application Data

[63] Continuation-in-part of Ser. No. 800,390, Nov. 27, 1991.

[51] Int. Cl.[5] ..... F25D 3/08

[52] U.S. Cl. ..... 62/372; 62/530; 62/400; 62/457.1; 220/466

[58] Field of Search ..... 62/457.1, 457.3, 400, 62/457.7, 372, 294, 393, 530, 371; 220/601, 466, 623, DIG. 1, 469, 486, 455; 217/72, 75, 74; 215/100 A

[56] References Cited

U.S. PATENT DOCUMENTS

| | | | |
|---|---|---|---|
| 224,202 | 2/1980 | Maus | 62/372 |
| 264,185 | 9/1982 | Miller | 62/400 |
| 848,228 | 3/1907 | Ettel | 62/400 |
| 2,003,050 | 5/1935 | Iselin | 62/32 |
| 2,556,893 | 6/1951 | Zwiebach et al. | 62/294 |
| 2,792,692 | 5/1957 | Bryan | 62/144 |
| 3,229,478 | 1/1966 | Alonzo | 62/294 |
| 3,614,875 | 10/1971 | McCallum | 62/372 |
| 3,789,622 | 2/1974 | Yanes | 62/396 |
| 3,998,072 | 12/1976 | Shaw | 62/530 |
| 4,071,160 | 1/1978 | Vick | 220/5 R |
| 4,608,837 | 9/1986 | Hickey et al. | 62/393 |
| 4,653,290 | 3/1987 | Byrne | 62/372 |
| 4,961,324 | 10/1990 | Allan | 62/457.3 |
| 4,963,175 | 10/1990 | Pace | 62/372 |
| 5,048,171 | 9/1991 | Bidwell et al. | 62/457.3 |

*Primary Examiner*—John M. Sollecito

[57] ABSTRACT

A container-cooler for a beverage, such as beer, includes a conventional keg-shaped outer shell, an inner vessel for containing the beverage retained within the shell, and a space between the inner vessel and the outer shell for receiving a cooling medium, such as ice.

2 Claims, 4 Drawing Sheets

FIG. 1
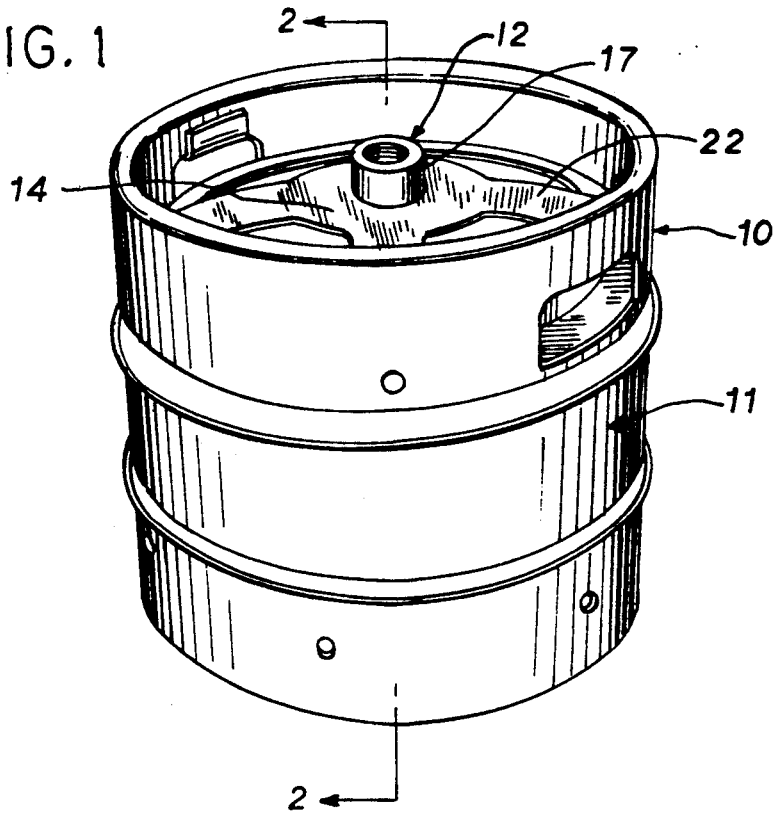
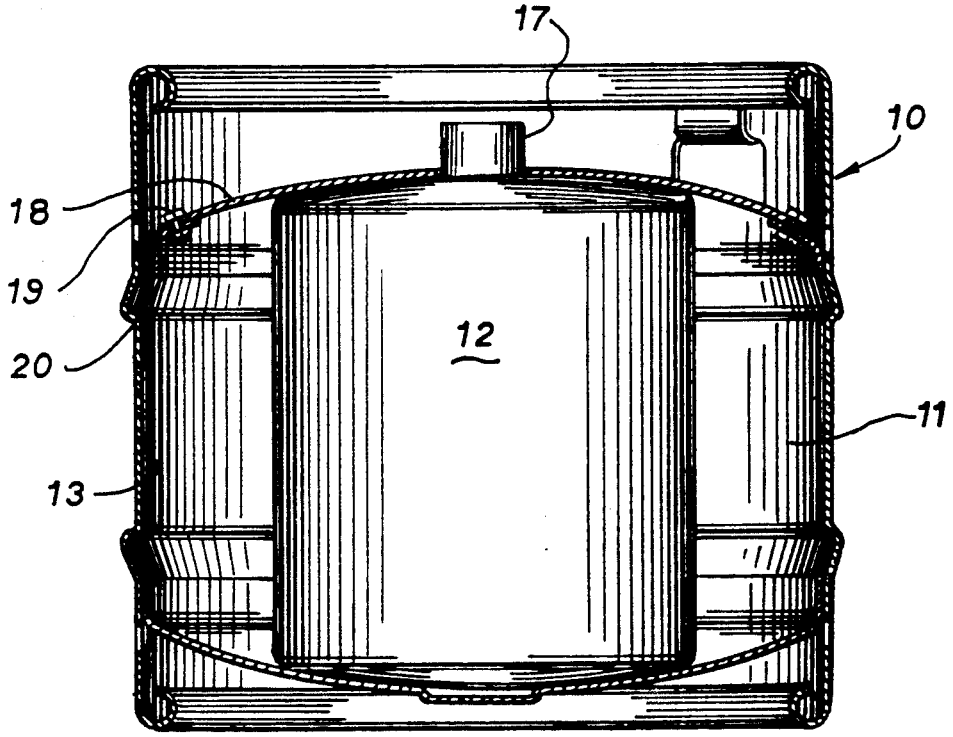
FIG. 2

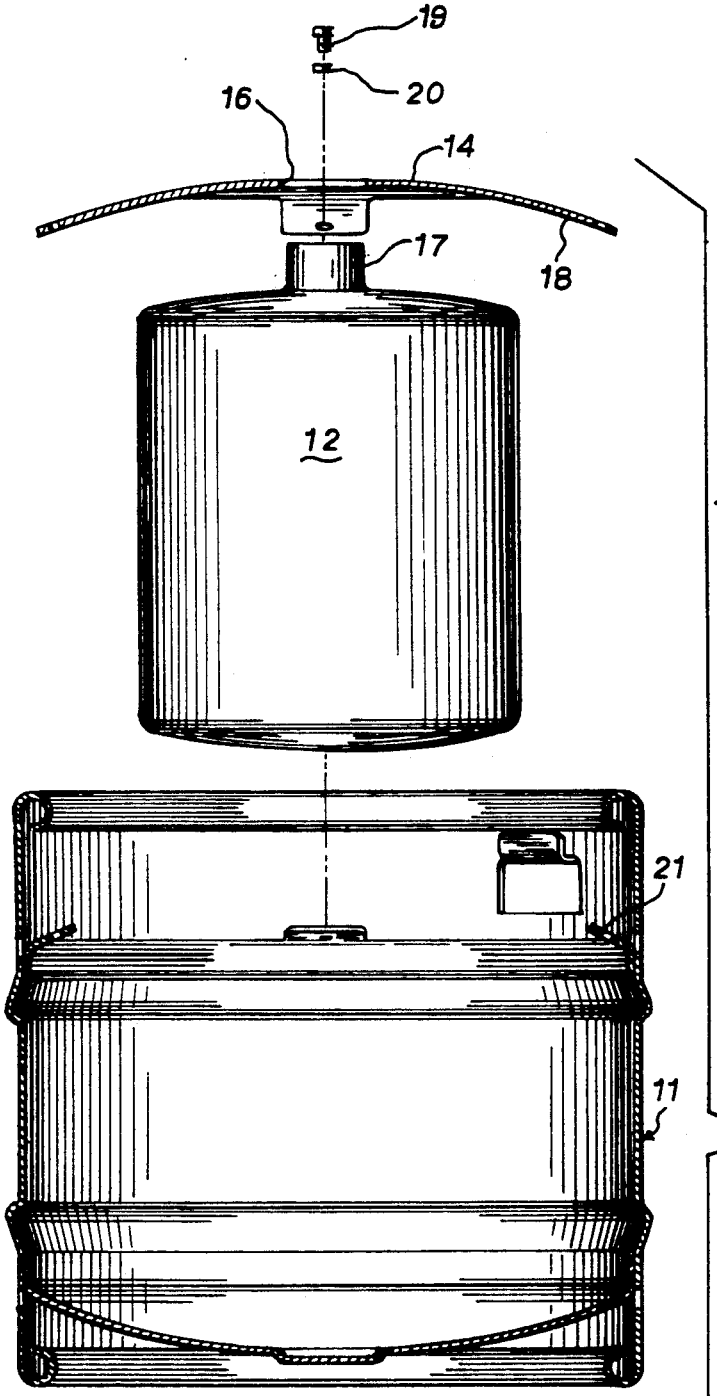
FIG. 4
FIG. 7
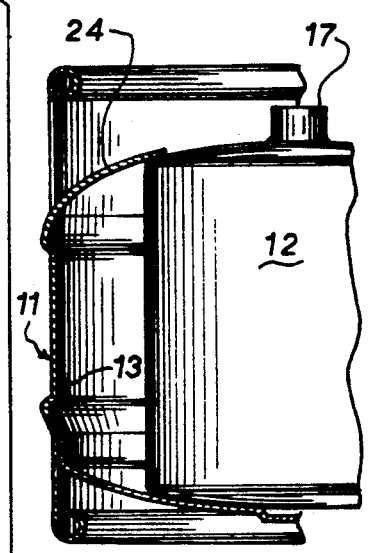

CONTAINER-COOLER

RELATED CASE

This application is a continuation-in-part of our pending patent application U.S. Ser. No. 07/800, 390, filed Nov. 27, 1991.

FIELD OF THE INVENTION

The present invention relates to a container for use with beverages. More particularly, it relates to a container-cooler for beer which permits the consumer to conveniently chill a large volume of beer and keep it cold.

BACKGROUND OF THE INVENTION

At the present time, if a consumer wishes to purchase a large volume of beer for either a party or personal use the consumer purchases a container called a keg. Since beer is best served chilled, the consumer must find a way to chill the beer in the keg and keep it cold until serving.

The beer in conventional kegs is usually chilled and kept cool prior to purchase by placing the keg in a refrigerator. After purchase by the consumer, the beer is usually kept cool by placing the keg in a tub which is large enough for the keg and a quantity of ice packed about the keg. Most consumers do not have or want either a refrigerator or a tub which is large enough for a keg of beer.

In the past, various attempts have been made to provide a more convenient means for cooling a keg of beer. One such attempt has been to provide a separate, oversized, outer jacket of some sort for the keg in which ice can be packed around the keg. Attempts to make a jacket an integral part of the keg have been unsuccessful because the outer jacket can interfere with the automated equipment which brewers use to handle conventional shaped kegs.

There is a need for a container-cooler in which beer can be sold and stored. There also is a need for a container-cooler for beer which can be handled by conventional automated keg handling equipment and which also provides the consumer a way of chilling the beer and keeping it cool without using tubs, outer jackets or refrigerators.

SUMMARY OF THE INVENTION

It is an object of the present invention to provide a container-cooler which can be used by the consumer to chill and keep beer cold and which also can be handled by conventional, automated, keg handling equipment.

The container-cooler of the present invention comprises a conventional keg-shaped outer shell, an inner vessel for beer within such shell, a space for receiving an effective amount of cooling medium between the outer wall of the inner vessel and the inner wall of the shell and means for retaining the inner vessel in the shell and maintaining the space for cooling medium.

The container-cooler also may be provided with means for introducing a cooling medium into the space between the inner vessel and the shell and for draining spent cooling medium from the space.

In one embodiment of the invention, the inner vessel is retained in the shell and the space is maintained by anchoring the inner vessel at its bottom to the inside of the outer shell.

In another embodiment, the top of the shell is only partially closed by a collar which is positioned around the neck of the inner vessel and which has a plurality of arms which extend out to and are secured to the shell to retain the inner vessel in the shell and maintain the annular space.

In still another embodiment, the inner vessel is retained in the shell and the space is maintained by fingers which extend inwardly from the shell.

In an especially preferred embodiment, the outer container and the inner container each are provided with webs or struts that can be bonded together to retain the inner container centered in the outer container and spaced above the bottom of the outer container so that cooling medium entering the maintained space also can flow beneath the inner container.

The space between the shell and the inner vessel is intended to be filled with ice. However, the container-cooler of the present invention makes possible other means of chilling or cooling the beer including the following:

1. Circulating a liquid chilled by an external device or mechanism through the space between the shell and vessel. For example, chilled water, such as that normally available from a typical household pressurized water supply, might be used. Alternatively, chilled salt water solutions might be circulated through the space and around the inner vessel.

2. Placing eutectic prechilled salts in the space. Such salts are commonly available in pouches which are sealed to prevent their leakage and to facilitate handling and reuse under such trade names, such as BLUE ICE. It is also possible that the hydration of nitrates or other salts might be used for the cooling process or the release of refrigerant gases.

The present invention provides a measure of consumer convenience not previously obtainable while at the same time providing the brewer with manufacturing and distribution economies based in part on the commonality of design and dimension of the container-cooler with the kegs for packaging beer which are already used in production.

It will be readily apparent to those skilled in the art that the foregoing and other objects of the invention can be achieved by the container-cooler of the present invention, a description of which follows.

BRIEF DESCRIPTION OF THE DRAWINGS

In the drawings:

FIG. 1 is a perspective view of the container-cooler of the present invention;

FIG. 2 is a view taken along lines 2—2 in FIG. 1;

FIG. 4 is an exploded view showing the components of the embodiment of FIG. 1;

FIG. 7 is a partial view, partly in section, of a third embodiment of the present invention;

BRIEF DESCRIPTION OF THE PREFERRED EMBODIMENT

In the first embodiment of the invention shown in FIGS. 1 to 4, the container-cooler 10 comprises an outer shell 11 having a conventional keg-shape and an inner beer receiving vessel 12 positioned within the shell 11

Figure 3:
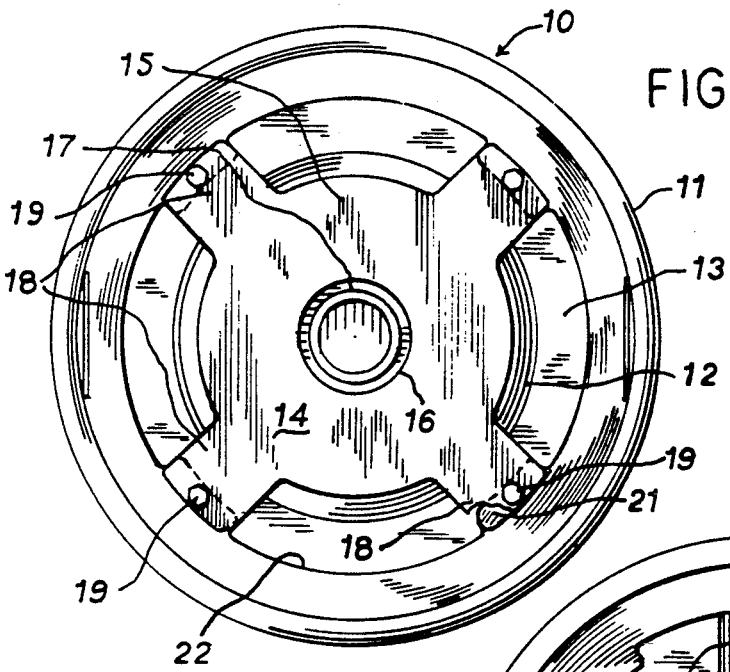
FIG. 3 is a top view of the container-cooler of FIG. 1.

As seen best in FIGS. 2 and 3, the vessel 12 is centrally positioned within the shell so that an annular space 13 exists between the outside 12*a* of the inner vessel 12 and the inside wall 11*a* of the shell 11.

Referring to FIG. 3, it can be seen that the top of the shell 11 is partially closed by a collar 14, which has a main body 15 with a central opening 16 which fits over the neck 17 of the vessel 12. The collar 14 has a plurality of arms 18 which extend radially from the main body 15 and which can be welded or secured with bolts 19 and nuts 20, seen in FIGS. 2 and 4, to tabs 21 which project inwardly from the top of the shell 11. Apertures 22 formed by the arms 18 of collar 14 and top of the shell 11 provide a convenient means for introducing ice or other cooling media in the space 13. The apertures 22, which are seen best in FIGS. 1 and 3, can be covered or left open.

The container-cooler of the present invention can be readily cleaned and filled using the existing automated keg-handling equipment of breweries. It also can be stored in the same manner as conventional kegs by warehouses, truckers, retail outlets and consumers.

The container-cooler of the present invention can be constructed from a shell 11 and inner vessel 12 made expressly for that purpose. However, it also can be conveniently made from a conventional beer keg by cutting the top of the keg off to form the outer shell 11 and collar 14 (as seen in FIG. 5) and then inserting and anchoring an inner vessel 12 designed for that purpose in the thus formed shell 11.

The collar 14 can be made of the same material as the shell 11 or a dissimilar material; provided, the collar 14 can be secured by some means to the shell 11 to retain the vessel 12 and maintain the space 13.

Figure 5:
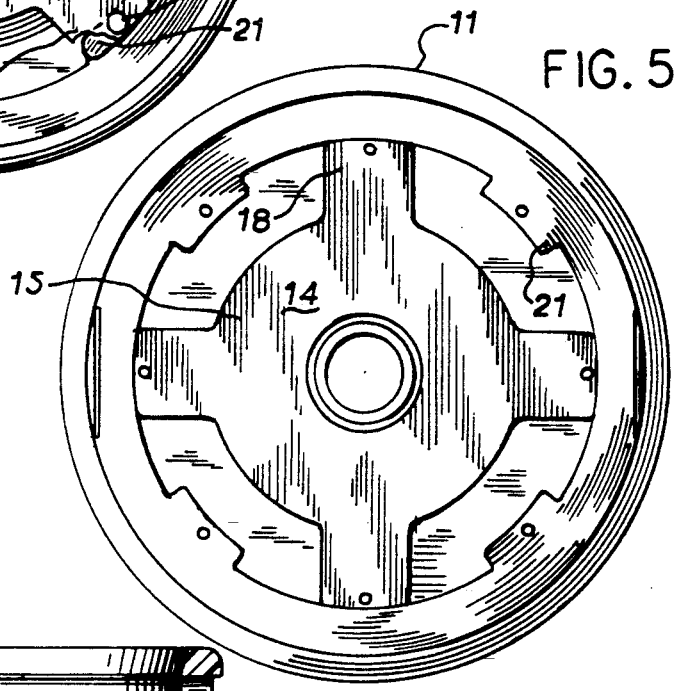
FIG. 5 is a top view of a keg from which a collar has been cut.

FIG. 5 shows the top of a conventional keg which has been cut to form a shell 11, a collar 14 and tabs 21. The collar 14 and tabs 21 thus formed can be used to retain the inner vessel 12 in place in the shell 11 as previously described.

Figure 6:
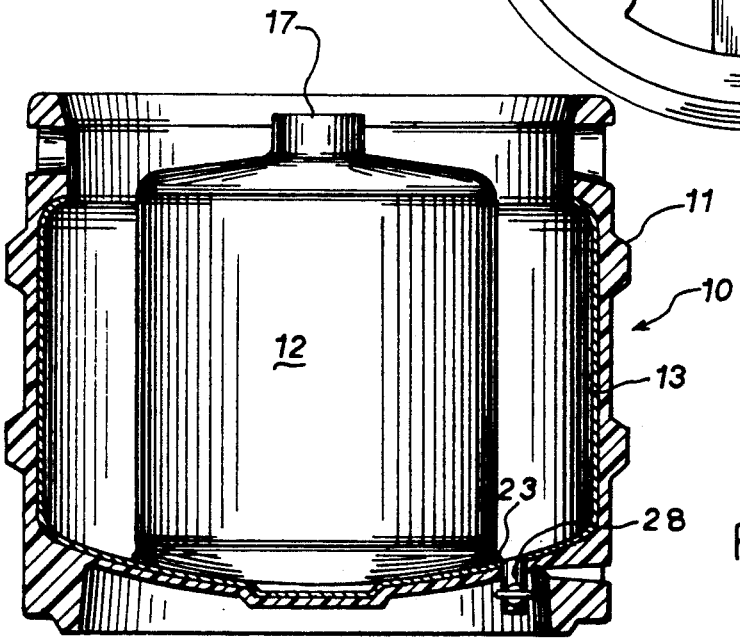
FIG. 6 is a view, partly in section, of a second embodiment of the present invention.

In FIG. 6 a second embodiment is shown in which the bottom of the vessel 12 is attached by a weld(s)23 to retain the vessel 12 inside of the shell 11 and to maintain the space 13.

Referring to FIG. 7 a partial view of a third embodiment of the container-cooler 10 is shown in which fingers 24 (only one which is shown) extend inwardly from the side wall of the shell 11 to retain the inner vessel 12 in place and maintain the space 13.

Figure 8:
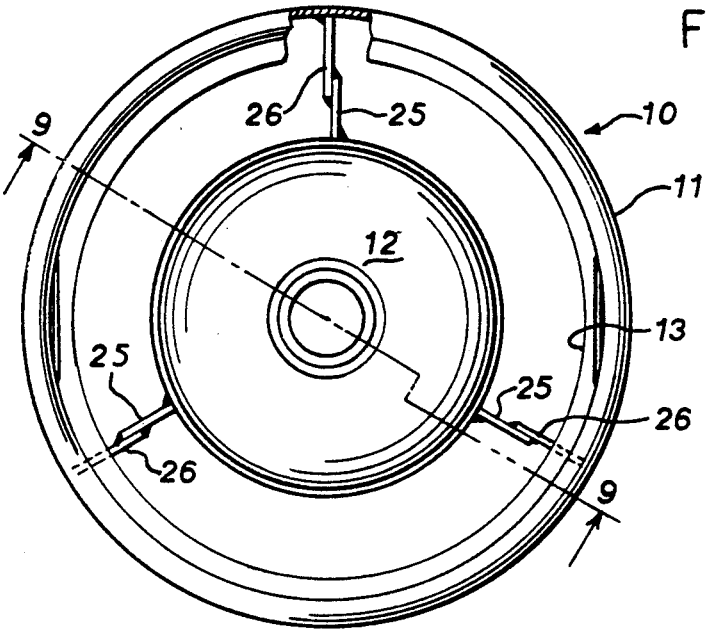
FIG. 8 is a top view of a fourth embodiment of the present invention.
Figure 9:
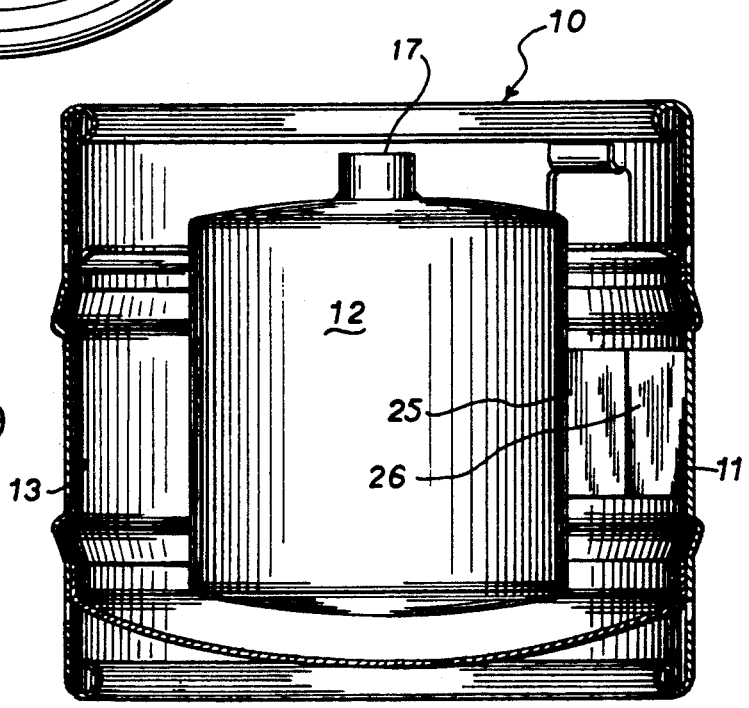
FIG. 9 is a view taken along lines 9—9 in FIG. 8.
Figure 10:
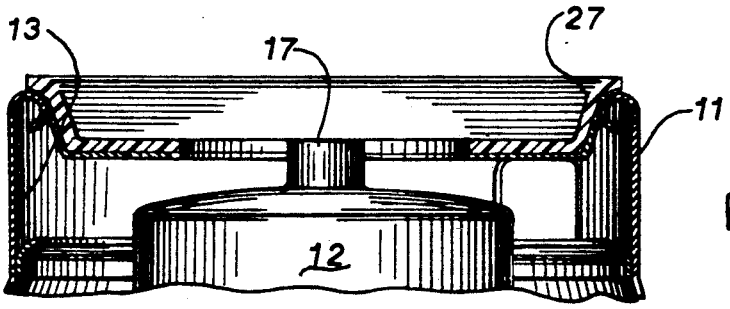
FIG. 10 is a view, in section, of the top of the embodiment of FIG. 8 with a cover.

In FIGS. 8 to 10, an especially preferred fourth embodiment of the container-cooler 10 is shown in which the inner vessel 12 has integral webs or struts 25 which are bonded or welded to webs or struts 26 of the shell 11 to retain the inner vessel 12 centered in the shell 11 to maintain the space 13 and to keep the bottom of the vessel above the inside bottom of the shell 11. This embodiment permits cooling medium to flow through the space 13 and under the inner vessel 12 thus providing maximum contact In the embodiment of FIG. 10, a removable cover 27 is shown which is preferably of metal or rigid plastic covered with a polymeric foam. The cover 27 provides additional insulation and prevents foreign materials from entering the space 13. The cover 27 can be dished, as shown, so that it can be used as a funnel for directing cooling media, such as and shell 11. The cover 27 also may be flat or take other forms so that when it is not used as a cover, it can be used as a cushion to be placed between the bottom of the container-cooler and a supporting surface, such as a table top.

The outer shell 11, if not obtained by the modification of a conventional keg, can be made of the same materials as a conventional keg, such as steel or plastic covered steel. However, the shell 11 also can be made of a suitable plastic o another material which is sufficiently durable for the intended use and handling conditions.

The outer shell 11, if desired, may be coated on the outside with a clear or colored lacquer for decoration or it might be covered with a shrink or stretch label made of polymeric material. Alternatively, it may be overwrapped either entirely or partially with a paper label which is adhesively applied to the shell. It also might be covered with a foam material to provide cushioning or insulating properties. The outer shell also can be coated with a polycoat. Polycoating provides a number of consumer and manufacturers advantages including comfortable hand feel, insulation (thermal), sound deadening, protective cushioning and improved aesthetic appeal.

The inner vessel 12 is sized to fit within the shell 11 and to provide the space 13 for a cooling medium. It is preferably formed of steel and it is closed after it is filled by a conventional keg closure. As a result, the usual types of dispensing pumps and taps can be used. Other materials that might be used for the vessel 12 include laminates of polymers with metal foils, other barrier adhesive polymers and wood fiber derivatives. In such cases, if the container-cooler is to be sterilized other sterilization means than steam might have to be employed, such as chemical sterilants.

If desired, the container-cooler 10 of the present invention can be provided with a drain plug 28 (seen only in FIG. 6) so that water from melted ice can be emptied from the space 13 without having to tip the container-cooler 10 upside down.

Among the advantages provided by the container 10 of the present invention are the following:

1. A consumer may use the annular space of the container-cooler to chill or cool the beer or other contents of the vessel 12 without the need for a separate tub or refrigerator.

2. A retailer can, if desired, sell the container-cooler and ice separately or as an added convenience place the ice in space 13 before sale.

3. The container-cooler permits a brewer to use existing keg handling and filling equipment.

4. The container-cooler can be refilled and recycled.

It will be apparent to those skilled in the art that the container-cooler of the present invention can be modified and changed without departing from the spirit and scope of the invention. Therefore, it is intended that the invention not be limited except by the claims.

What is claimed is:

1. A container-cooler for beer, said container-cooler comprising:

(a) a conventional keg-shaped rigid outer shell;

(b) a rigid inner vessel for beer having top and bottom walls having a diameter and a circumferential side wall extending between the top and bottom walls, said vessel having a neck for closure by a conventional keg closure and disposed therein being centrally positioned within said outer shell with the top of said neck below the neck of said shell;

(c) an annular space for ice between the outer wall of the inner vessel and the inner wall of the shell; and (d) retaining means for retaining the inner vessel in the shell and maintaining said space, said retaining means being a collar which fits around the neck of the vessel and over said top wall and which has a plurality of spaced-apart arms which extend out from the neck to and are secured to the shell, said arms forming a plurality of horizontally elongated apertures providing areas to the annular space through which ice can be introduced.

2. A container-cooler of claim 1 which includes outlet means at the bottom of the shell providing communication between the annular space and the outside.

* * * * *